US007637637B2

(12) United States Patent
Liu et al.

(10) Patent No.: US 7,637,637 B2
(45) Date of Patent: Dec. 29, 2009

(54) OUTDOOR LED LAMP ASSEMBLY

(75) Inventors: You-Xue Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/104,375

(22) Filed: Apr. 16, 2008

(65) Prior Publication Data

US 2009/0262533 A1 Oct. 22, 2009

(51) Int. Cl.
*F21V 29/00* (2006.01)

(52) U.S. Cl. ..... 362/294; 362/218; 362/240; 362/241

(58) Field of Classification Search ..... 362/218, 362/237, 240, 244, 247, 294, 373, 547, 800
See application file for complete search history.

(56) References Cited

U.S. PATENT DOCUMENTS

| | | | | |
|---|---|---|---|---|
| 7,285,903 | B2 * | 10/2007 | Cull et al. | 362/800 |
| 7,434,959 | B1 * | 10/2008 | Wang | 362/218 |
| 7,513,639 | B2 * | 4/2009 | Wang | 362/373 |
| 2008/0130299 | A1 * | 6/2008 | Dorogi | 362/373 |

* cited by examiner

*Primary Examiner*—Y My Quach Lee
(74) *Attorney, Agent, or Firm*—Frank R. Niranjan

(57) ABSTRACT

An LED lamp assembly includes a receiving member, a first LED lamp and a second LED lamp. The receiving member has a pair of opposite slope surfaces. The first and second LED lamps are mounted on the opposite slope surfaces of the receiving member. Each of the first and second LED lamps includes a heat sink and a plurality of LED modules mounted on the heat sink. A number of the LED modules of the first LED lamp is more than that of the second LED lamp. When the LED lamp assembly is mounted on a roadside, the first LED lamp is oriented slantwise toward a leaving direction of vehicles while the second LED is oriented slantwise toward a coming direction of the vehicles.

9 Claims, 5 Drawing Sheets

OUTDOOR LED LAMP ASSEMBLY

BACKGROUND OF THE INVENTION

1. Field of the Invention

The present invention relates to an outdoor LED lamp assembly, and more particularly to an outdoor LED lamp assembly used as a road lamp, having a large illumination angle while having no dis-comfort glare or disability glare.

2. Description of Related Art

The technology of light emitting diodes has rapidly developed in recent years from indicators to illumination applications. With the features of long-term reliability, environment friendliness and low power consumption, the LED is viewed as a promising alternative for future lighting products.

As we all know, express roads and major roads must use full cut-off luminaire. An angle of the maximum illuminance of the full cut-off luminaire is varied between 0°~65°. The maximum permissible illuminance intensities of the full cut-off luminaire in 90° direction and in 80° direction are 10 cd/lm and 30 cd/lm respectively.

A conventional outdoor LED lamp assembly comprises a pair of symmetrical LED lamps. Each LED lamp comprises a heat sink and a plurality of LED modules mounted on a bottom surface of the heat sink. A distribution of light intensity from the outdoor LED lamp assembly has two ways. One way is that an angle of the maximum illuminance of the outdoor LED lamp assembly is varied between 60°~65°, but the maximum permissible illuminance intensity in 90° direction and in 80° direction is stronger than that of the allowed; thus, the dis-comfort glare or the disability glare is generated. Another way is that the angle of the maximum illuminance of the outdoor LED lamp assembly is varied between 25°~35°, and the maximum permissible illuminance intensity in 90° direction and in 80° direction are lower than the needed. In this state, the dis-comfort glare or the disability glare does not exist, but light is focused on a small area which has seriously affected the illumination efficiency of the outdoor LED lamp assembly.

What is needed, therefore, is an outdoor LED lamp assembly having a large illumination angle and an anti-glare effect.

SUMMARY OF THE INVENTION

An LED lamp assembly includes a receiving member, a first LED lamp and a second LED lamp. The receiving member has a pair of opposite slope surfaces. The first and second LED lamps are mounted on the opposite slope surfaces of the receiving member. Each of the first and second LED lamps includes a heat sink and a plurality of LED modules mounted on the heat sink. The heat sink has a plurality of differently-angled planar surfaces at a bottom thereof. The LED modules are mounted to the planar surfaces, respectively. The slope surfaces are tilted outwardly along top-to-bottom direction and tilted outwardly along front-to-rear direction. A number of the LED modules of the first LED lamp is more than that of the second LED lamp.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
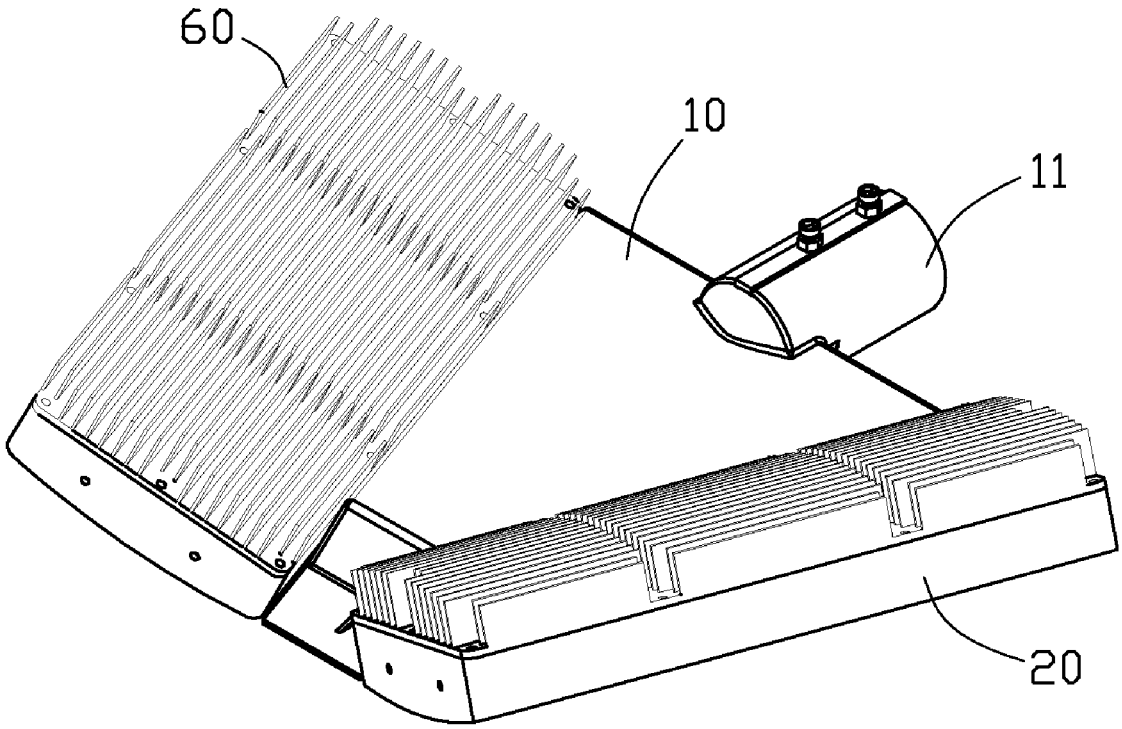
FIG. 1 is an assembled view of an outdoor LED lamp assembly in accordance with a preferred embodiment of the present invention.

Referring to FIG. 1, an LED lamp assembly (not labeled) comprises a receiving member 10, a first LED lamp 20 and a second LED lamp 60 assembled on opposite sides of the receiving member 10. A driving circuit module (not labeled) is received in the receiving member 10 to electronically connect with and supply power to the first and second LED lamps 20, 60.

Figure 2:
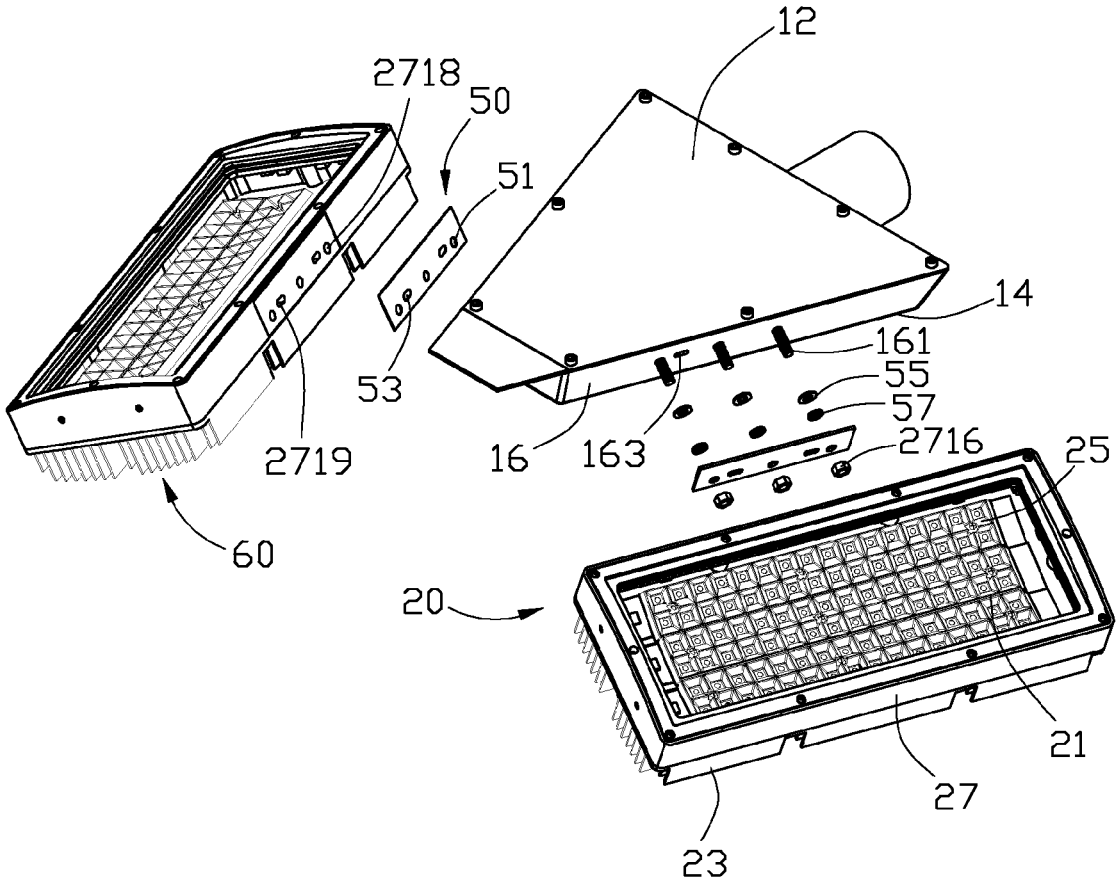
FIG. 2 is an exploded view of FIG. 1, but viewed from a different aspect.

Referring to FIG. 2, the receiving member 10 has a triangular configuration and has a top surface 14, a bottom surface 12 opposite to the top surface 14, a pair of mounting surfaces 16 connecting right and left edges of the top and bottom surfaces 14, 12, and a rear surface (not labeled) and a front surface (not labeled) connecting rear and front edges of the top and bottom surfaces 14, 12 respectively. A lamp holder 11 is secured to the rear surface of the receiving member 10 of at a rear of the outdoor LED lamp assembly. The lamp holder 11 is for fastening with a support post (not shown) to secure the LED lamp assembly in a desired position. The bottom surface 12 and the top surface 14 are trapeziform and parallel to each other. The bottom surface 12 has a slightly larger area than that of the top surface 14; thus, the mounting surfaces 16 extend outwardly and downwardly from the edges of the top surface 14 to the edges of the bottom surface 12. In addition, the rear surface is larger than the front surface; thus, the mounting surfaces 16 extend outwardly and rearwards from the front surface to the rear surface. Three spaced elongated screws 161 extend outwardly from each of the mounting surfaces 16 to be engaged with the first and second LED lamps 20, 60. A pair of through holes 163 (only one shown) is defined in the mounting surfaces 16 for extension of wires (not shown) therethrough from the driving circuit board into the first and second LED lamps 20, 60.

The first LED lamp 20 comprises three LED modules 21, a heat sink 23 supporting and cooling the LED modules 21, three reflectors 25 over the LED modules 21, and a housing 27 mounted around a periphery of the heat sink 23 to enclose the LED modules 21 and the reflectors 25 therein.

Figure 3:
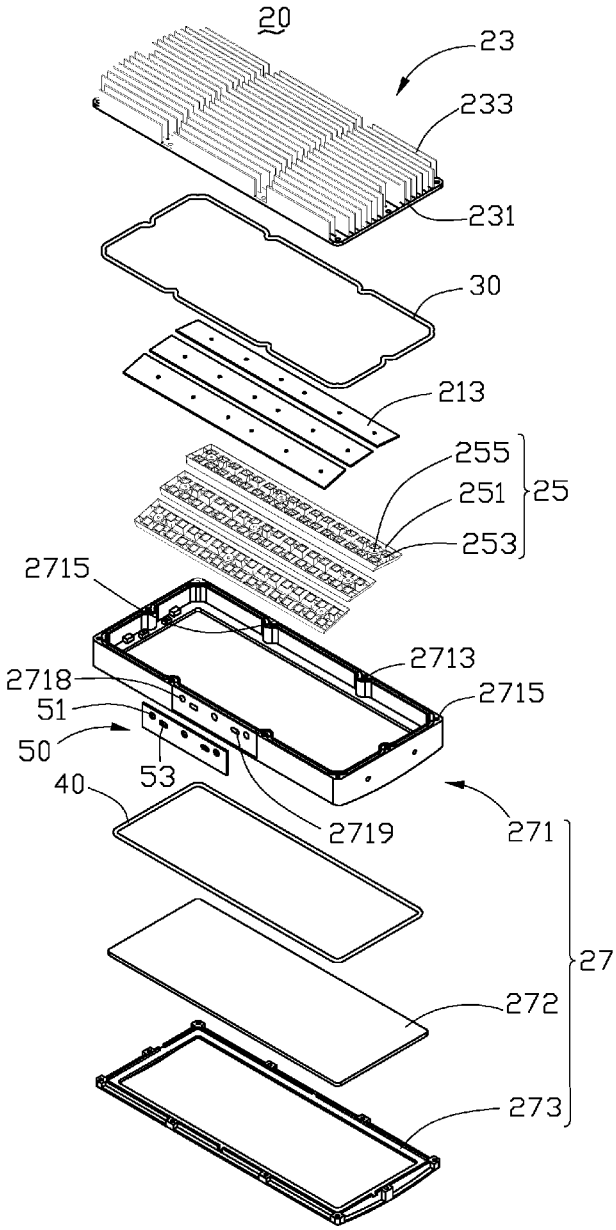
FIG. 3 is an exploded view of an LED lamp of FIG. 1.
Figure 4:
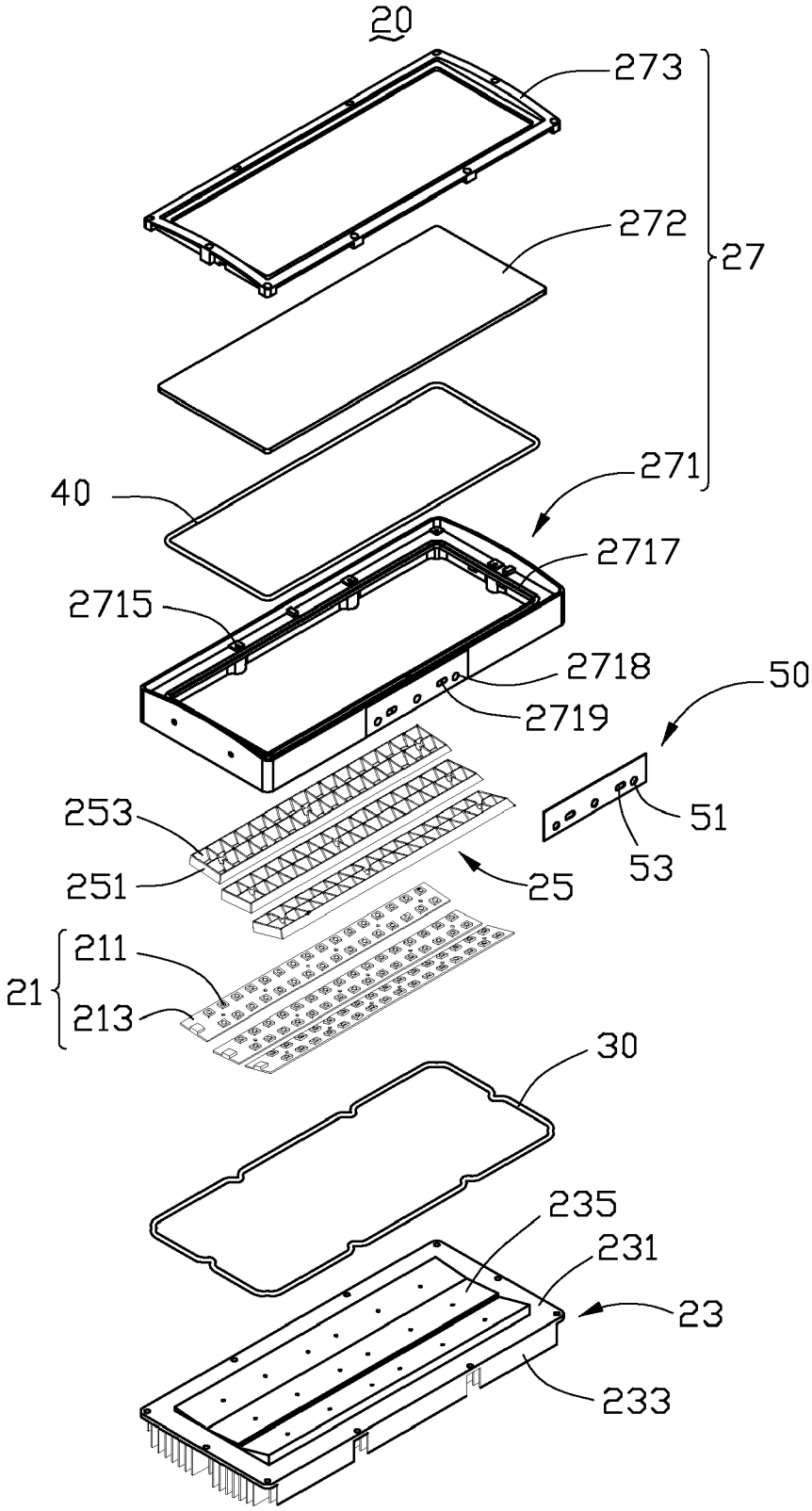
FIG. 4 is an inverted view of FIG. 3.

Referring to FIGS. 3-4, the heat sink 23 is made of a metal with a high heat conductivity, such as copper or aluminum. The heat sink 23 comprises a rectangular base 231 and a plurality of fins 233 extending from the base 231. The base 231 comprises a top surface (not labeled) and a bottom surface (not labeled) opposite to the top surface. The fins 233 extend from the top surface of the base 231. A centre of the bottom surface of the base 231 protrudes three elongated wedged plates having planar surfaces 235. The LED modules 21 are attached on the surfaces 235. The surfaces 235 are angled with each other.

Each LED module 21 comprises an elongated printed circuit board 213 and a plurality of spaced LEDs 211 evenly mounted on a side of the printed circuit board 213. The LEDs 211 of each LED module 21 are arranged along a longitudinal direction of the printed circuit board 213. Each LED module 21 is mounted in a thermally conductive relationship with the bottom surface of the heat sink 23 and electronically connects with the driving circuit module.

Each reflector 25 is located over the printed circuit board 213 of a corresponding LED module 21. The reflector 25 can reflect light generated by the LEDs 211. The reflector 25 comprises a rim 251 and a plurality of ribs (not labeled) within the rim 251. The rim 251 and the ribs connect with each other to define a plurality of through holes 253. The LEDs 211 are received in the through holes 253, respectively. Light generated by the LEDs 211 is reflected by the reflectors 25 to increase the intensity of the light emitted from the first LED lamps 20. A plurality of sleeves 255 is formed in the reflector 25 along a thickness direction thereof. A plurality of screws (not shown) are used to extend through the sleeves 255 and the printed circuit boards 213 to engage with the heat sink 23 thereby to mount the reflectors 25 and the LED modules 21 on the heat sink 23.

The housing 27 comprises a rectangular frame 271 engaging with the heat sink 23, a transparent cover 272 enclosed in the frame 271 and covering a bottom opening (not labeled) of the frame 271, and a rectangular fixture 273 located at a bottom of the frame 271 and mounting the cover 272 on the frame 271.

The frame 271 forms a plurality of protruding portions 2713 on inner surfaces thereof. Each protruding portion 2713 and each corner of the frame 271 define a screw hole 2715 therein. Screws (not shown) extend through the heat sink 23 and engage into a top portion of the screw holes 2715 to mount the frame 271 on the heat sink 23. The LED modules 21 are enclosed in the frame 271. A rectangular ring-shaped gasket 30 is sandwiched between the frame 271 and the heat sink 23 to enhance hermeticity of the connection between the frame 271 and the heat sink 23. A plurality of connecting plates (not labeled) extends inwardly from bottom of the inner surfaces of the frame 271. A plurality of supporting plates 2717 extends inwardly and downwardly from edges of the connecting plates to support the cover 272. The fixture 273 presses the cover 272 against the supporting plates 2717. Screws (not shown) extend through the fixture 273 and engage into the screw holes 2715 to mount the fixture 273 on the frame 271. A rectangular ring-shaped gasket 40 is sandwiched between the cover 273 and the supporting plates 2717 to enhance hermeticity of the connection between the cover 273 and the supporting plates 2717. A centre of an elongated sidewall (not labeled) of the frame 271 defines three holes 2718 corresponding to the elongated screws 161 of the receiving member 10. A nut 2716 is received in each of the holes 2718 to engage with the elongated screws 161. Two through holes 2719 are defined between the holes 2718 for extension of the electric wires to be extended from the driving circuit module into the first LED lamp 20.

The second LED lamp 60 has a configuration similar to the first LED lamp 20, and also includes a heat sink 23 and a housing 27. The second LED lamp 60 comprises two LED modules 21 mounted on the heat sink 23 and two reflectors 25 over the LED modules 21. The LED modules 21 of the first and second LED lamps 20, 60 are asymmetrical in respect to the receiving member 10: the number of the LED modules 21 of the second LED lamp 60 is less than that of the first LED lamp 20.

A pair of rectangular linking plates 50 are sandwiched between the elongated sidewall of the first and second LED lamps 20, 60 and the mounting surfaces 16 of the receiving member 10. The linking plate 50 defines three mounting holes 51 corresponding to the holes 2718 of the frame 271 of a corresponding one of the first and second LED lamps 20, 60, and two holes 53 corresponding to the through holes 2719 of the frame 271 of the corresponding one of the first and second LED lamps 20, 60. The elongated screws 161 extend through the mounting holes 51 of the linking plates 50, O-rings 55, 57 to threadedly engage with the nuts 2716 in the holes 2718 of the frames 271 of the first and second LED lamps 20, 60, thereby to mount the first and second LED lamps 20, 60 on the opposite sides of the receiving member 10. In this state, the heat sinks 23 extend outwardly and upwardly from the mounting surfaces 16 of the receiving member 10, as shown in FIG. 1. By the provision of the mounting surfaces 16 which are titled outwardly along top-to-bottom direction and tilted outwardly along front-to-rear direction, and the provision of the differently-angled planar surfaces 235 at the bottom the of the heat sinks 23, the LED modules 21 are oriented toward a plurality of different directions, whereby the LED lamp assembly in accordance with the present invention can have a large illumination angle. In addition, since the LED modules 21 have an intimate contact with the heat sinks 23, the heat generated by the LEDs 211 can be timely dissipated to surrounding air by the fins 233 of the heat sinks 23. Thus, the LED lamp assembly can work normally when the LEDs 211 are activated.

Figure 5:
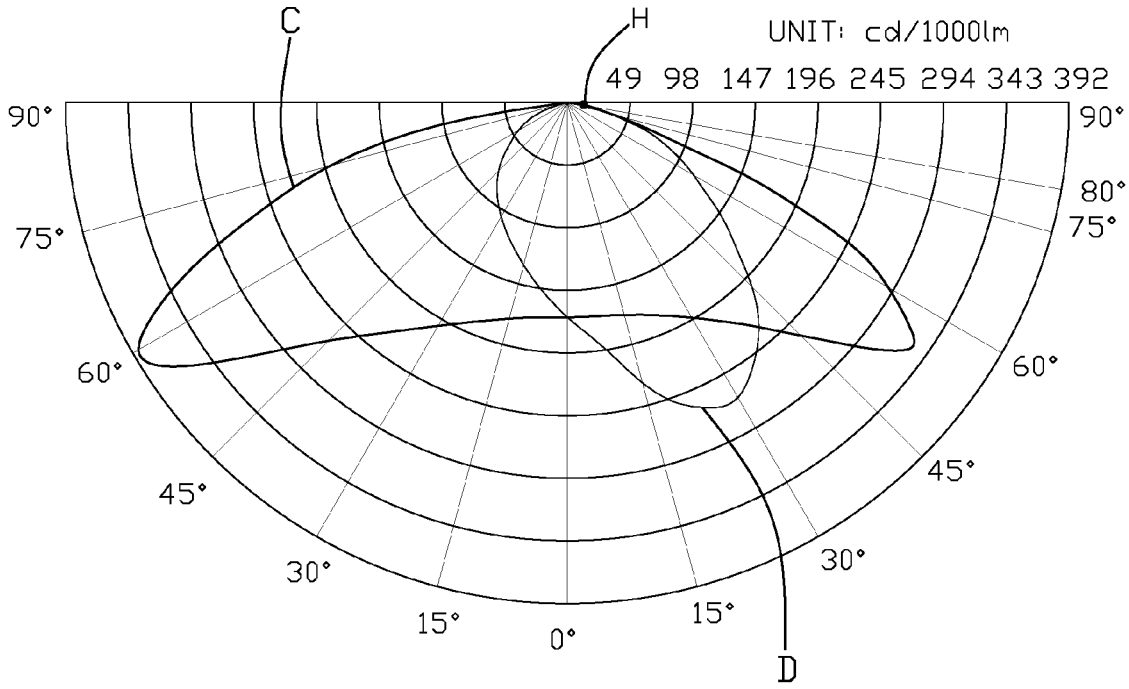
FIG. 5 is a luminous intensity curve graph of the outdoor LED lamp assembly.

In use, when the LED assembly is mounted on a roadside of a road with the bottom surface 12 of the receiving member 10 faces vertically downwardly toward the road, the second LED lamp 60 is oriented slantwise toward a coming direction of the vehicle while the first LED lamp 20 is oriented slantwise towards a leaving direction of the vehicle in respect to the LED lamp assembly. When the power of the outdoor LED lamp assembly is 160 watts, the luminous intensity curve of the outdoor LED lamp assembly is shown in FIG. 5. Referring to FIG. 5, the C curve shows a luminous intensity curve along a direction parallel to the road, and the D curve shows a luminous intensity curve along a direction perpendicular to the road. The C curve and the D curve located at a left side of FIG. 5 show the luminous intensity curve of the first LED lamp 20. The C curve and the D curve located at a right side of FIG. 5 show the luminous intensity curve of the second LED lamp 60. An angle of the maximum illuminance of the second LED lamp 60 is between 50°~60°, which satisfies the CIE standard. The illuminance intensity in 80° direction is shown at an H spot in the C curve, which corresponds to the luminous intensity value of 21 cd/1000 lm. The illuminance intensity in 90° direction is shown at a spot (not shown) in the D curve, which corresponds to the luminous intensity value of 8.5 cd/1000 lm. In this state, the illuminance intensities in 90° direction and in 80° direction are both slightly lower than the maximum permissible illuminance intensities in these two directions, i.e., 10 cd/lm and 30 cd/lm. Thus, the dis-comfort or the disability glare is not generated and the road is fully illuminated by the outdoor LED lamp assembly in accordance with the present invention.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An outdoor LED lamp assembly comprising:

a receiving member having a pair of opposite slope surfaces; and a first LED lamp and a second LED lamp mounted on the opposite slope surfaces of the receiving member, each of the first and second LED lamps comprising a heat sink and a plurality of LED modules mounted on the heat sink, wherein the heat sink of each of the first and second LED lamps comprises a base having a bottom surface, the bottom surface of the base is protruded into a plurality of elongated planar surfaces which are angled with each other, and the LED modules are attached on the elongated planar surfaces, respectively;

wherein a number of the LED modules of the first LED lamp is more than that of the second LED lamp.

2. The outdoor LED lamp assembly as claimed in claim 1, wherein the receiving member has a triangular configuration and has a top surface and a bottom surface, the bottom surface and the top surface are trapeziform and parallel to each other, the bottom surface is large than the top surface, the slope surfaces extend outwardly and downwardly from edges of the top surface to edges of the bottom surface.

3. The outdoor LED lamp assembly as claimed in claim 2, wherein the first and second LED lamps extend slantwise and upwardly from the slope surfaces.

4. The outdoor LED lamp assembly as claimed in claim 2, wherein each of the first and second LED lamps comprises a plurality of reflectors over the LED modules, respectively, the reflectors being secured to the heat sink.

5. The outdoor LED lamp assembly as claimed in claim 4, wherein a pair of housings engage with bottom portions of the heat sinks of the first and second heat sinks to enclose the LED modules and the reflectors therein.

6. The outdoor LED lamp assembly as claimed in claim 5, wherein the housing comprises a rectangular frame engaging with the heat sink, a transparent cover enclosed in the frame and covering an opening of the frame, and a rectangular fixture located at a bottom of the frame and mounting the cover on the frame.

7. The outdoor LED lamp assembly as claimed in claim 6, wherein a pair of gaskets are respectively sandwiched between the heat sink and the frame and between the frame and the transparent cover.

8. The outdoor LED lamp assembly as claimed in claim 1, wherein a pair of linking plates are sandwiched between the first and second LED lamps and the opposite sides of the receiving member respectively.

9. The outdoor LED lamp assembly as claimed in claim 8, wherein a plurality of screws extends outwardly from the opposite slope surfaces of the receiving member through the linking plates and engages into nuts received in the first and second LED lamps to mount the first and second LED lamps on the opposite slope surfaces of the receiving member.

* * * * *